US010747244B2

(12) United States Patent
Manhart et al.

(10) Patent No.: US 10,747,244 B2
(45) Date of Patent: Aug. 18, 2020

(54) TRANSFORMER DEVICE WITH MODIFIED VOLTAGE TAP ARRANGEMENT

(71) Applicant: SAI Advanced Power Solutions, Elmhurst, IL (US)

(72) Inventors: James S. Manhart, Chicago, IL (US); John Ryan, Island Lake, IL (US)

(73) Assignee: SAI Advanced Power Solutions, Elmhurst, IL (US)

( * ) Notice: Subject to any disclaimer, the term of this patent is extended or adjusted under 35 U.S.C. 154(b) by 366 days.

(21) Appl. No.: 15/895,638

(22) Filed: Feb. 13, 2018

(65) Prior Publication Data

US 2019/0250655 A1 Aug. 15, 2019

(51) Int. Cl.

| | |
|---|---|
| ***H01F 27/28*** | (2006.01) |
| ***G05F 1/14*** | (2006.01) |
| ***H01F 27/06*** | (2006.01) |
| ***H01F 27/30*** | (2006.01) |
| ***H01F 27/32*** | (2006.01) |
| ***H01F 29/04*** | (2006.01) |
| ***H01F 27/26*** | (2006.01) |
| ***H01F 30/12*** | (2006.01) |
| ***H01F 27/29*** | (2006.01) |
| *H01H 9/00* | (2006.01) |

(52) U.S. Cl.

CPC ..... *G05F 1/14* (2013.01); *H01F 27/06* (2013.01); *H01F 27/263* (2013.01); *H01F 27/2828* (2013.01); *H01F 27/29* (2013.01); *H01F 27/306* (2013.01); *H01F 27/32* (2013.01); *H01F 29/04* (2013.01); *H01F 30/12* (2013.01); *H01H 9/0005* (2013.01)

(58) Field of Classification Search

USPC ..... 336/192, 66–68, 150, 210

See application file for complete search history.

(56) References Cited

U.S. PATENT DOCUMENTS

| | | | | |
|---|---|---|---|---|
| 5,621,372 | A * | 4/1997 | Purohit | H01F 27/263 336/196 |
| 8,576,032 | B2 * | 11/2013 | Herbert | F16K 7/16 251/129.15 |
| 9,984,833 | B2 * | 5/2018 | Kaltenborn | H01H 9/0027 |
| 2007/0132534 | A1 * | 6/2007 | Osbun | H01F 27/306 336/150 |

* cited by examiner

*Primary Examiner* — Elvin G Enad
*Assistant Examiner* — Kazi S Hossain
(74) *Attorney, Agent, or Firm* — Leydig, Voit & Mayer, Ltd.

(57) ABSTRACT

A transformer configured to receive a primary incoming voltage and provide at least two secondary output voltages. The transformer includes at least one secondary output assembly which includes at least two secondary voltage stabs, the number of voltage stabs being the same as the number of secondary output voltages, connected and configured to provide access to a respective secondary output voltage. The chosen secondary output voltage is connected by coupling a tap change link between a lug landing and either of the at least two secondary voltage stabs. Another of the secondary output voltages is provided by connecting coupling the tap change link between the lug landing and the other of the at least two secondary voltage stabs.

18 Claims, 10 Drawing Sheets

TRANSFORMER DEVICE WITH MODIFIED VOLTAGE TAP ARRANGEMENT

FIELD

Embodiments of this disclosure relate to transformers and, more particularly, to an arrangement for rapidly modifying voltage taps for a transformer.

BACKGROUND

Power distribution units often include multi-phase transformers capable of delivering power levels. These multi-phase transformers may be multiple single phase transformers connected together or may be a single multi-phase transformer with a shared core. Single phase transformers or single multi-phase transformers can have multiple windings. That is, the transformer can have more than one primary or secondary winding. Multiple winding transformers allow re-configurability. For example, a transformer with one primary winding and multiple secondary windings can be configured to deliver different power levels by selecting voltage of one of the secondary windings as the transformer's output voltage. Sometimes a multiple winding transformer is achieved with one primary winding and one secondary winding, but the secondary winding includes a center tap which divides the secondary winding in two.

To access voltages from preferred windings in a multiple winding transformer, voltage taps are typically provided. Voltage taps are typically accessed by cables coupled to fittings positioned along a voltage distribution path. When a change of voltage provided is desired, the cables are disconnected from the undesired voltage path fittings, and connected to the desired voltage path fittings. Unfortunately, this procedure can be time consuming, error prone, and cumbersome.

SUMMARY

According to an aspect of the disclosure, there is provided a transformer for providing selectively configurable output voltages. The transformer is configured to receive a primary incoming voltage and provide at least two secondary output voltages. The transformer includes at least one secondary output assembly, the secondary output assembly including at least two secondary voltage stabs, wherein the number of voltage stabs is the same as the number of secondary output voltages. The secondary voltage stabs are connected and configured to provide access to a respective secondary output voltage of the at least two secondary output voltages. The transformer also includes a lug landing with at least one secondary cable attachment lug supported on and electrically connected with the at least one lug landing. The transformer also includes a tap change link. The tap change link configured for attachment to the lug landing and either of the at least two secondary voltage stabs. At least one fastener couples the tap change link to the lug landing, and at least one fastener couples the tap change link to one of the at least two secondary voltage stabs.

DETAILED DESCRIPTION OF EMBODIMENTS

Figure 1:
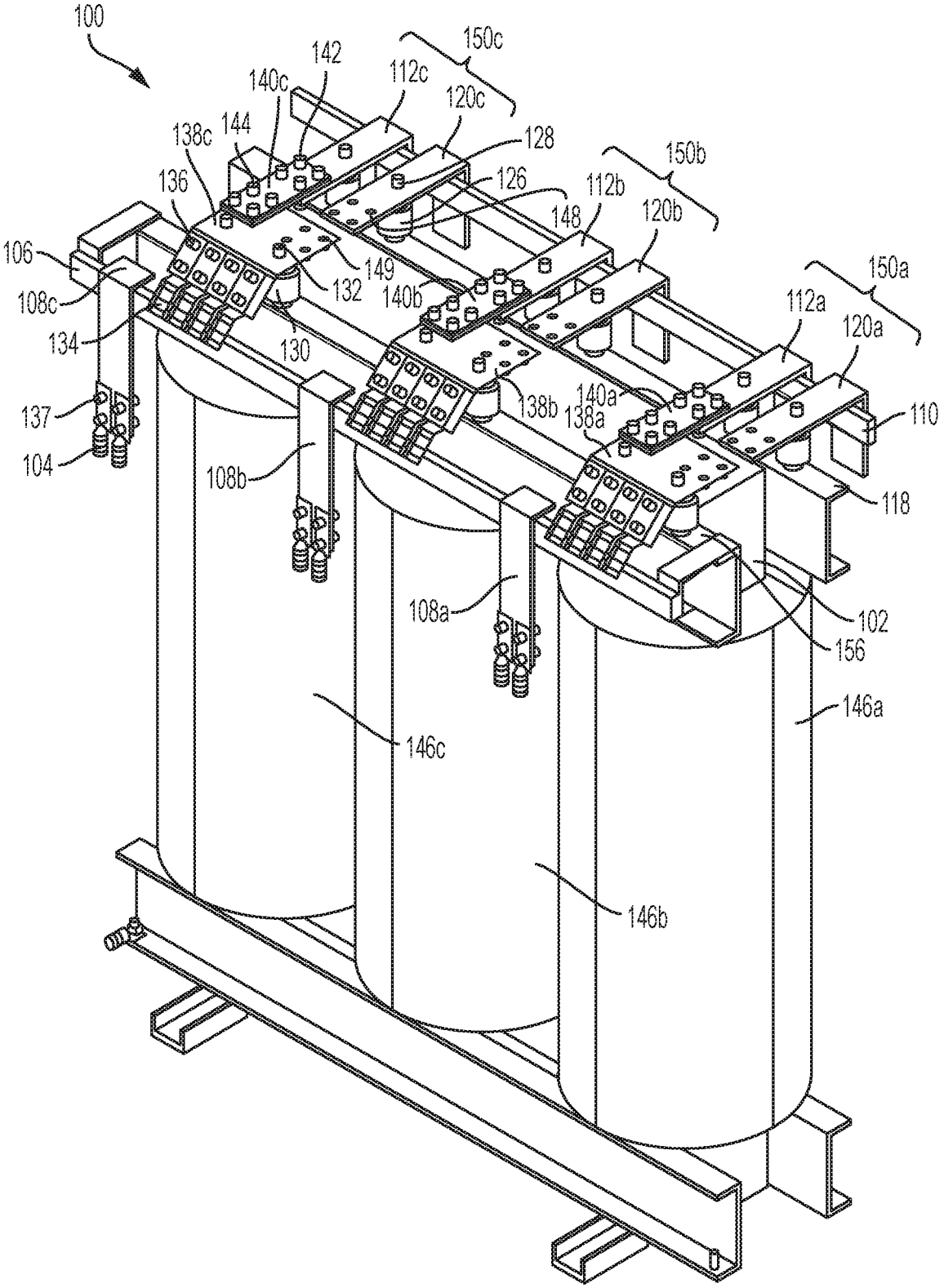
FIG. 1 shows an isometric view of a multi-phase transformer including a voltage tap arrangement according to aspects of the disclosure.

The present disclosure relates to an arrangement for rapid changing of voltage taps in connection with a transformer with multiple secondary windings. Such a transformer will be useful in applications where efficiently selecting between more than one step-up or step-down voltage is desired at the secondary side of the transformer. The embodiment of the disclosure illustrated in FIG. 1 provides a certain application utilizing a multi-phase transformer with efficiently configurable secondary voltage taps. Specifically, FIG. 1 illustrates the multi-phase transformer 100 configured to be used in a three-phase power system. As illustrated, the multi-phase transformer 100 includes a core 102 and three coil units 146—one for each phase of the three-phase power system. The core 102 is shared between the three coil units 146, thus the illustrated embodiment of the multi-phase transformer 100 uses a single three-phase transformer. It is understood that other configurations using three single phase transformers can be used to construct a three-phase power system, and the multi-phase transformer 100, as illustrated, is provided as an example. Each of the coil units 146 is coupled to a respective efficiently configurable tap change link 140. Each tap change link 140 couples one of two secondary windings (not illustrated) of its respective core unit 146 to the output of the multi-phase transformer. For example, tap change link 140*c* couples one of two secondary windings of coil unit 146*c* to an output of the transformer which may be accessed through cable attachment lugs, e.g., cable attachment lug 134. The operation of the efficiently configurable tap change link 140 will be described further below. Additionally, while in the illustrated embodiment only two secondary windings are provided, more are contemplated based on the application utilizing the transformer.

As an aside, while not illustrated, other embodiments are contemplated outside of the three-phase power context. For instance, a transformer with an efficiently configurable tap change link for selecting one of a plurality of secondary windings may be used as a circuit breaker in a variety of applications. Additionally, although a single three-phase transformer is illustrated in FIG. 1, the configurable tap change link can be applied to a single-phase transformer with one coil unit for selecting one of a plurality of secondary windings of the single phase transformer.

In FIG. 1, without loss of generality, the single three-phase transformer will be referred to with respect to its core 102 and coil units 146 as the transformer 102, 146. As such, discussion of the transformer 102, 146 can be extended to single-phase transformers with only one coil unit or polyphase transformers with more than one coil unit. That is, in a single-phase transformer with only one coil unit, the transformer 102, 146 refers to a single core with a single coil unit while in a polyphase transformer, e.g., the multi-phase transformer 100, the transformer 102, 146 refers to the shared coil 102 and the three coil units 146*a*, 146*b*, and 146*c*. In FIG. 1, in the transformer 102, 146, each coil unit 146 may include both primary and secondary windings. In some embodiments, more than two secondary windings are provided in each core unit 146. The transformer 102, 146 is configured to provide multiple voltage outputs based on a tap configuration provided by the tap change links 140. In one aspect, a primary incoming voltage may be stepped up to one or more secondary voltages. In that aspect, the tap configuration determines the step-up voltage. In another aspect, a primary incoming voltage may be stepped down to one or more secondary voltages. In that aspect, the tap configuration determines the step-down voltage. One or more tap configurations may thus be used to configure one or more secondary voltages for a given primary voltage.

A primary incoming voltage may be provided to the transformer 102, 146 by way of connection to primary cable attachment lugs 104 coupled to one or more primary voltage stabs 108. The primary voltage stabs 108 are mounted to dielectric bars 106. In the embodiment illustrated in FIG. 1, three primary voltage stabs 108 are provided, and the primary voltage stabs 108 are electrically connected to a respective primary winding of the transformer 102, 146 in its respective coil unit 146. For example, primary voltage stab 108*c* is electrically connected to a primary winding of coil unit 146*c*. While the arrangement will be understood by those of skill in the art, in the interests of clarity, wiring and electrical connectivity of the primary voltage stabs 108 to the coil units 146 is not shown in FIG. 1. Additionally, for clarity, specific connectivity of the primary and secondary windings of the transformer 102, 146 is not shown. The transformer 102, 146, for example, may be configured in a delta-wye configuration or any other appropriate configuration.

In order to permit a draw of dual power from the transformer 102, 146, at least one secondary output assembly 150 is provided. Three such secondary output assemblies 150*a*, 150*b*, and 150*c* are illustrated in the figures. The number of secondary output assemblies depends on the number of coil units 146, where one secondary output assembly 150 is provided for one coil unit 146. The secondary output assemblies 150 include a plurality of secondary voltage stabs 112, 120. As illustrated, secondary output assembly 150*c* utilizes secondary voltage stabs 112*c* and 120*c*, secondary output assembly 150*b* utilizes secondary voltage stabs 112*b* and 120*b*, and secondary output assembly 150*a* utilizes secondary voltage stabs 112*a* and 120*a*.

The secondary voltage stabs 112, 120 may be mechanically supported by a dielectric support bar 110. The secondary voltage stabs 112, 120 are coupled to the transformer 102, 146 by way of respective dielectric insulators 126. The dielectric insulators 126 may connect the associated secondary voltage stab 112, 120 to the transformer 102, 146 in any suitable way, such as with a fastener 128. In certain embodiments, the dielectric insulators 126 are partially threaded and fastened on each side. Additionally, in certain embodiments, if a fastener 128 is used, the fastener 128 can fasten an associated secondary voltage stab 112, 120 to an associated dielectric insulator 126 on a top side, and another fastener 128 can fasten the dielectric insulator 126 to a transformer core clamp 118 of the transformer 102, 146.

The dielectric insulator 126 can be any suitable length, and can come in a variety of shapes, such as cylindrical. In the embodiment illustrated in the figures, for example, the dielectric insulator 126 has a barrel-like shape. In some embodiments, the width will be no greater than twice the length of the dielectric insulator, and in some embodiments, the width will be no greater than the length of the dielectric insulator. The dielectric insulator can be made of a material such as glass, porcelain, thermoset plastic or any suitable material.

In order to provide a connection to the secondary voltage stabs 112, 120, the respective one of the secondary output assemblies 150 include at least one secondary cable attachment lug 134 supported on and electrically connected with a lug landing 138. In the illustrated embodiments, a plurality of secondary cable attachment lugs 134 are supported on and electrically connected with a lug landing 138 for each secondary output assembly 150. Those of skill in the art will appreciate that when a respective lug landing 138 is mechanically coupled with its respective secondary voltage stab 112, 120, an electrical connection is provided between its respective coil unit 146, the respective secondary voltage stab 112, 120, the respective lug landing 138, and respective secondary cable attachment lugs 134.

In accordance with an aspect of the disclosure, FIG. 1 illustrates two primary cable attachment lugs 104 attached to each primary voltage stab 108 and four secondary cable attachment lugs 134 attached to each lug landing 138. The number of primary cable attachment lugs 104 and secondary cable attachment lugs 134 may be determined based on a magnitude of current expected to flow through the primary voltage stabs 108 and the secondary voltage stabs 112, 120, respectively. In one aspect, when the transformer 102, 146 is configured to step-up the primary incoming voltage, a larger magnitude of current is expected to flow through the primary voltage stabs 108 compared to the lug landing 138, and as such, a larger number of primary cable attachment lugs 104 is provided on the primary voltage stabs 108 compared to the number of secondary cable attachment lugs 134 provided on the lug landing 138. In another aspect, when the transformer 102, 146 is configured to step-down the primary incoming voltage, a smaller magnitude of current is expected to flow through the primary voltage stabs 108 compared to the lug landing 138, and as such, a smaller number of primary cable attachment lugs 104 is provided on the primary voltage stabs 108 compared to the number of secondary cable attachment lugs 134 provided on the lug landing 138. In another aspect, the number of primary cable attachment lugs 104 is equal to a number of secondary cable attachment lugs 134.

The primary cable attachment lugs 104 may be attached to the primary voltage stabs 108 using one or more fasteners 137. Fasteners 137 allow a mechanical and electrical connection of the primary cable attachment lugs 104 to the primary voltage stabs 108. Similarly, the secondary cable attachment lugs 134 may be attached to the lug landing 138 using one or more fasteners 136. The fasteners 136 mechanically secure the secondary cable attachment lugs 134 to the lug landing 138, also allowing an electrical coupling between the lug landing 138 and the secondary cable attachment lugs 134. The cable attachment lugs 134 may be compression lugs or mechanical lugs.

The lug landing 138 may be mechanically coupled to a transformer core clamp 156 using fastener 132 and through a dielectric insulator 130. The mechanical coupling of the lug landing 138 to the transformer core clamp 156 holds the lug landing 138 in place in reference to the position of the transformer 102, 146. FIG. 1 shows two fasteners 132 holding the lug landing 138 in place, but other configurations may be provided where more than two fasteners 132 hold the lug landing 138 in place.

Each secondary output assembly 150, for example, secondary output assembly 150*c*, further includes a tap change link 140, and fasteners for coupling the tap change link 140 with a respective secondary voltage stab 112, 120 and an associated lug landing 138. The tap configuration of the multi-phase transformer 100 for selecting between one of two secondary voltage stabs 112/120 may be determined based on the tap change link(s) 140 for each respective secondary assembly 150. The tap change link(s) 140 provides an electrical connection between the lug landing 138 and the secondary voltage stabs 112, 120. On one end, the tap change link 140 may be electrically and mechanically coupled to the lug landing 138 using one or more fasteners 144, and on the other end, the tap change link 140 may be electrically and mechanically coupled to the secondary voltage stabs 112, 120 using one or more fasteners 142. FIG. 1 illustrates an embodiment where four fasteners 144 and four fasteners 142 are used to make the tap change link 140*c* couplings, but it is understood that two, three, five, or any number of fasteners may be used on either side, and the number of fasteners 144 may be different than the number of fasteners 142. In order to facilitate connection of the tap change link(s) 140 with the secondary voltage stabs 112, 120 and the lug landing 138, holes 148, 149 are provided in the secondary voltage stabs 112, 120 and the lug landing 138 for receipt of fasteners 142, 144. The holes 148 facilitate mechanical coupling of the tap change link 140 to the secondary voltage stabs 112, 120. The tap change link 140 may be a conductive metal, for example, a metal including copper.

Figure 2:
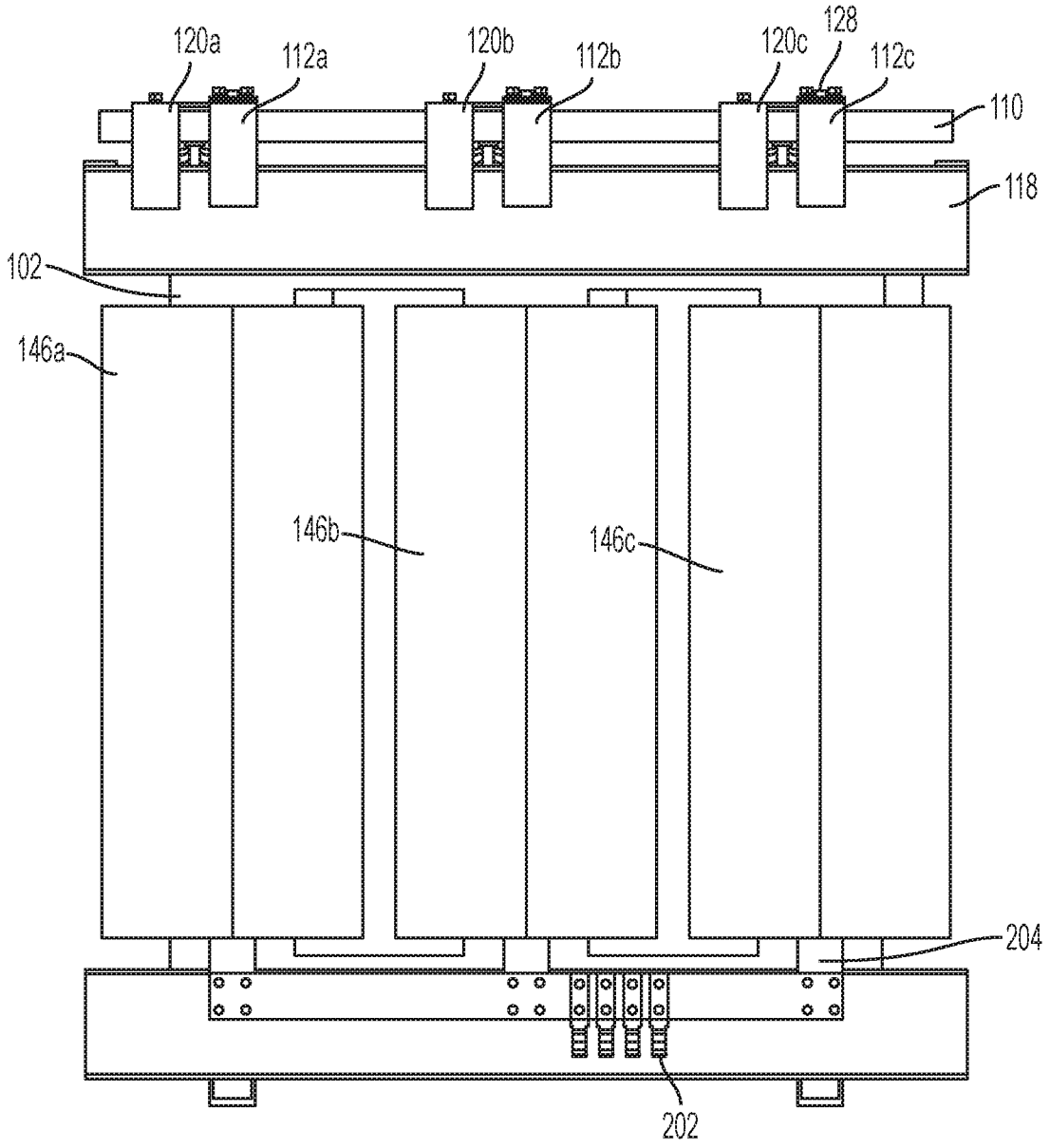
FIG. 2 shows a rear elevational view of the multi-phase transformer of FIG. 1.
Figure 3:
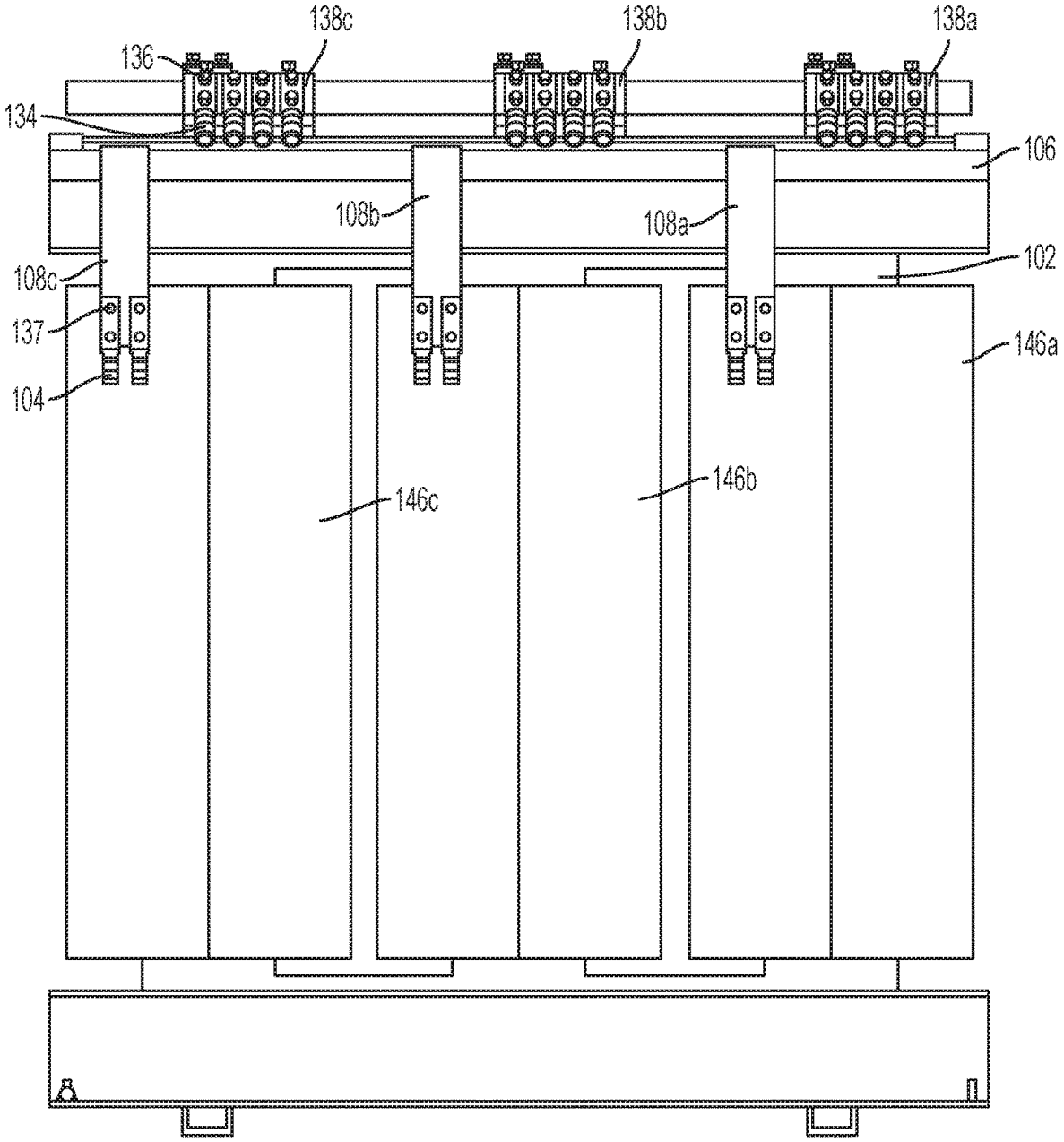
FIG. 3 shows a front elevational view of the multi-phase transformer of FIGS. 1 and 2.

In accordance with an aspect of the disclosure, FIG. 2 provides a rear elevational view of the multi-phase transformer 100 of FIG. 1. The transformer 102, 146 of the multi-phase transformer 100 may include a neutral terminal electrically connected to a neutral voltage stab 204 with one or more neutral cable attachment lugs 202. In accordance with an aspect of the disclosure, FIG. 3 provides a front elevational view of the transformer unit 100 of FIG. 1. The core 102 is shown to be shared among the coil units 146*a*, 146*b*, and 146*c*, extending from the top of the coil units 146 through their centers and to the bottom.

Figure 4:
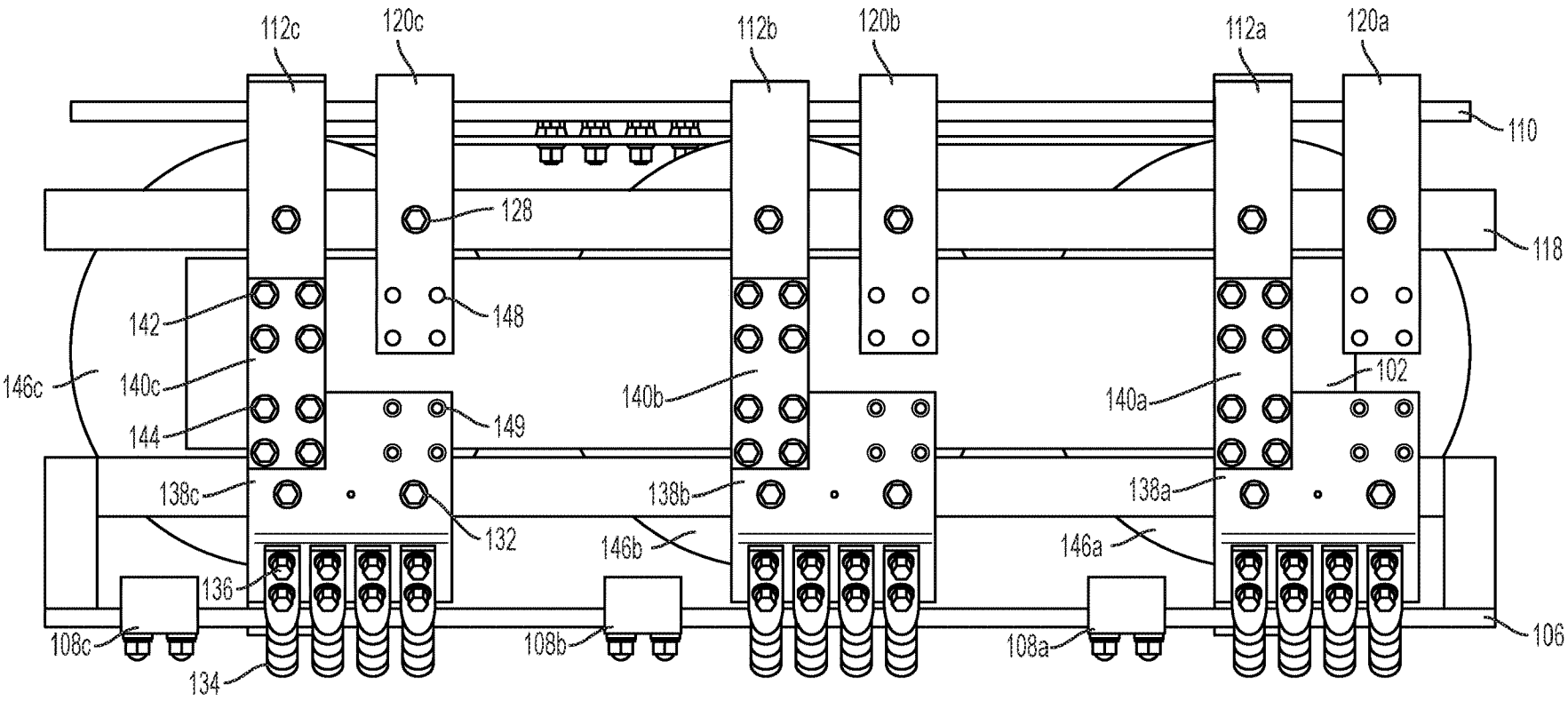
FIG. 4 shows a plan view of the multi-phase transformer of FIGS. 1-3 in a first voltage configuration.
Figure 5:
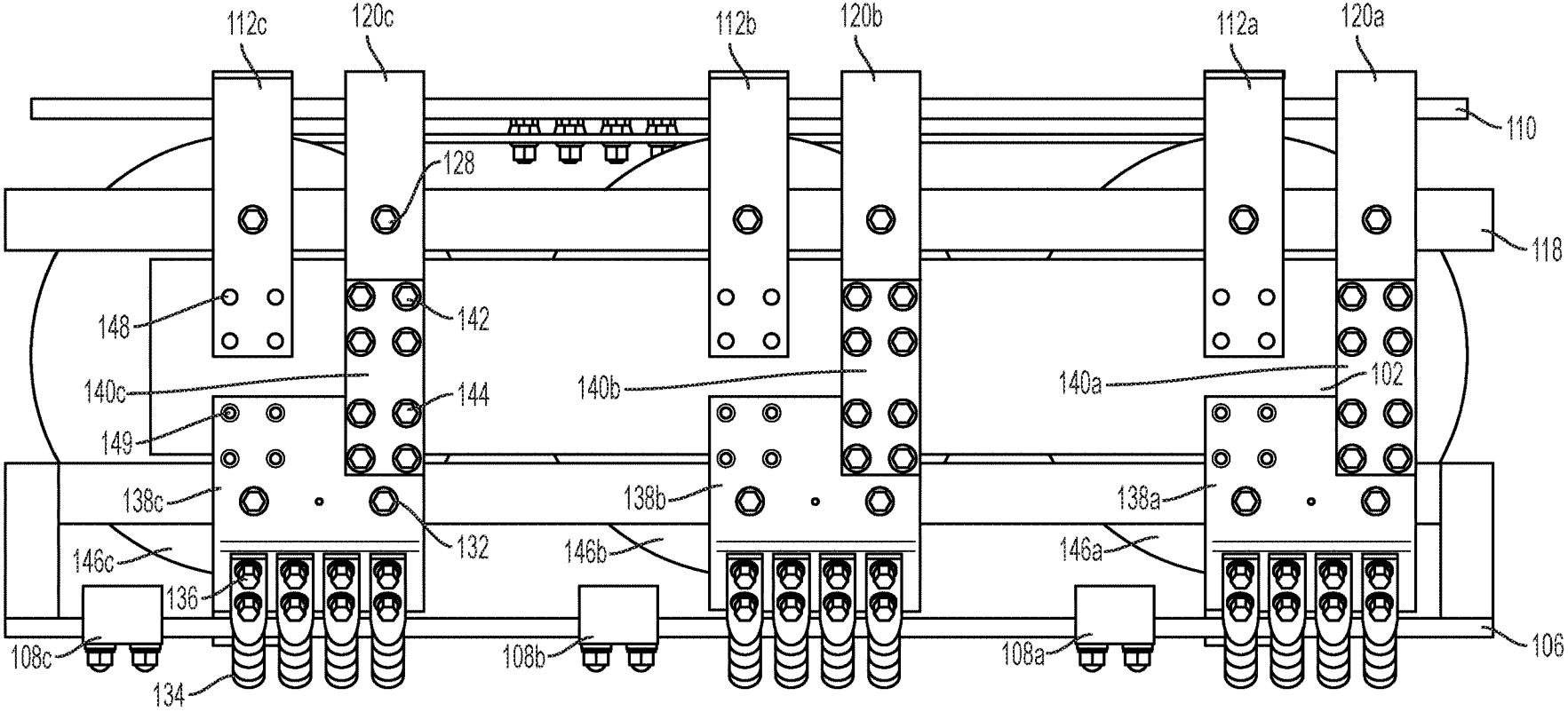
FIG. 5 shows a plan view of the multi-phase transformer of FIGS. 1-3 in a second voltage configuration.

In accordance with an aspect of the disclosure, FIG. 4 provides a plan view of the multi-phase transformer 100 of FIG. 1 in a first voltage configuration, while FIG. 5 shows the multi-phase transformer 100 in a second voltage configuration. That is, FIGS. 1-4 illustrate the tap change link(s) 140 connecting the lug landing(s) 138 with secondary voltage stabs 112. In this configuration, fasteners 142, 144 are disposed within holes 148, 149 in secondary voltage stabs 112 and the lug landing(s) 138, respectively. In contrast, FIG. 5 illustrates the tap change link(s) 140 connecting the lug landing(s) 138 with secondary voltage stabs 120. In this configuration, fasteners 142, 144 are disposed within holes 148, 149 in secondary voltage stabs 120 and the lug landing(s) 138, respectively.

By way of example only, in one embodiment, the transformer 102, 146 steps-down an incoming voltage; for example, the primary incoming voltage on primary voltage stab 108 is 480V, and the secondary voltage stabs 112 provide a secondary output voltage of 240V and secondary voltage stabs 120 provide a secondary output voltage of 120V. The tap change links 140 are used to select either the 240V secondary voltage stabs or the 120V secondary voltage stabs for output through the secondary cable attachment lugs 134. FIG. 4 illustrates a configuration where the 240V secondary voltage stabs are selected (the first configuration), and FIG. 5 illustrates a configuration where the 120V secondary voltage stabs are selected (a second configuration).

Figure 6:
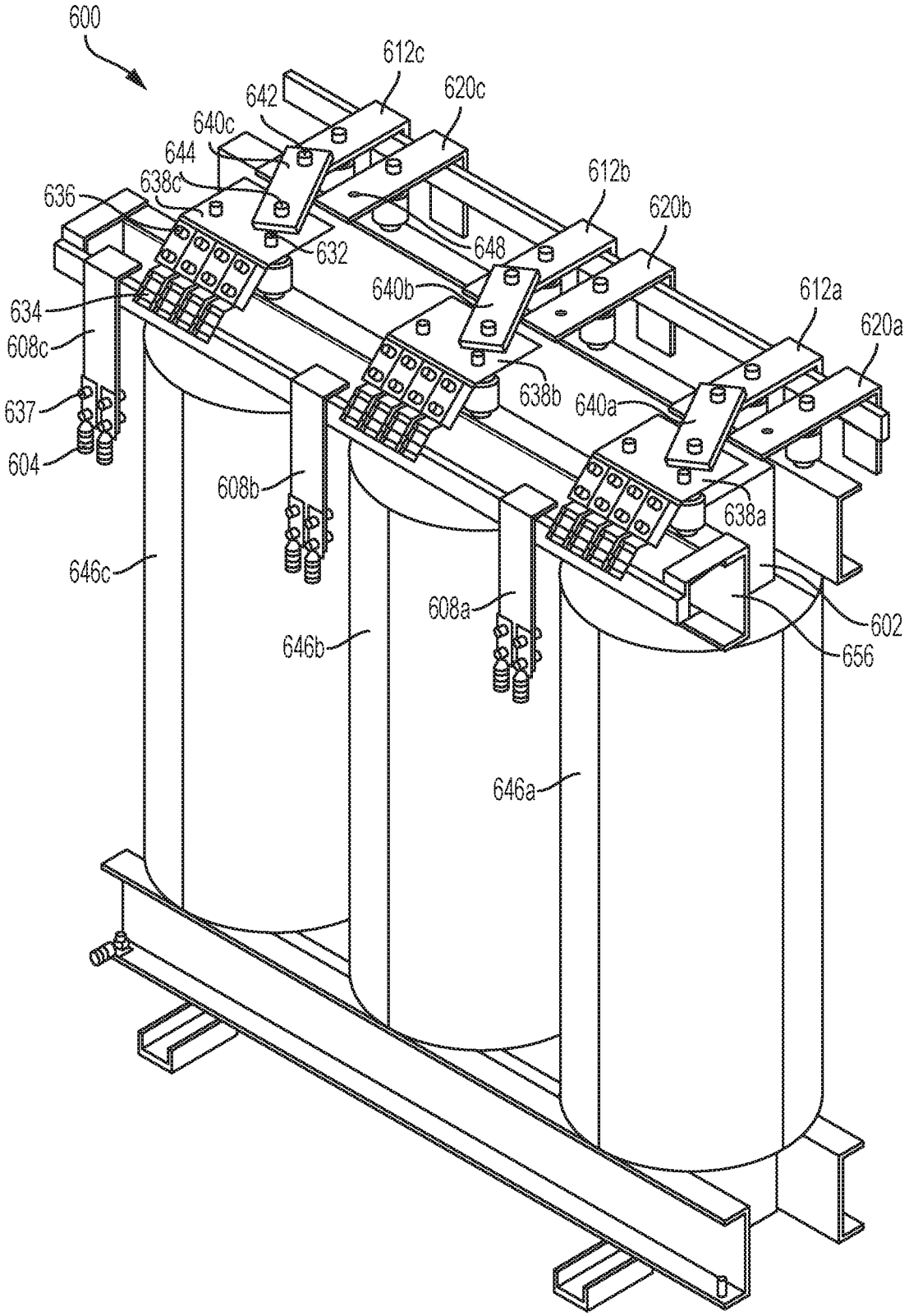
FIG. 6 shows an isometric view of a second embodiment of a multi-phase transformer including a voltage tap arrangement according to aspects of the disclosure.
Figure 7:
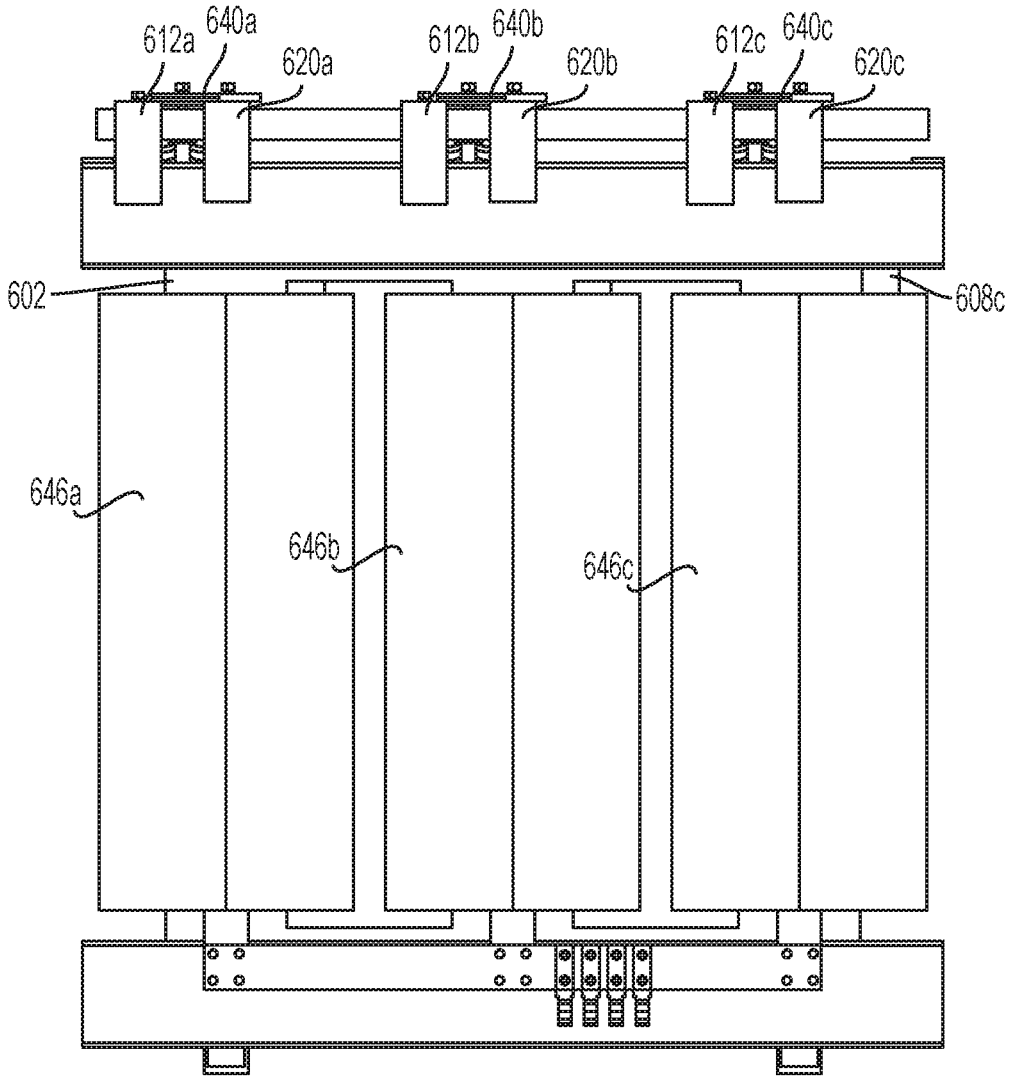
FIG. 7 shows a rear elevational view of the multi-phase transformer of FIG. 6.
Figure 8:
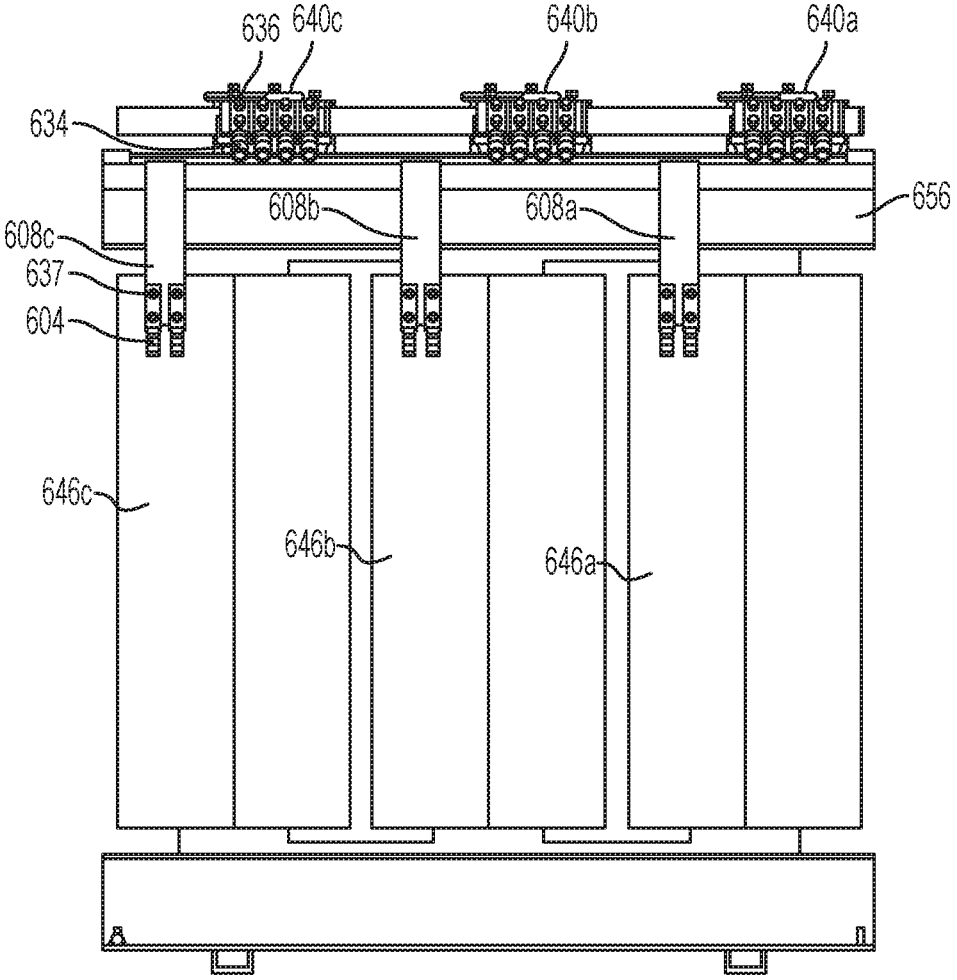
FIG. 8 shows a front elevational view of the multi-phase transformer of FIGS. 6 and 7.

FIG. 6 provides an exemplary multi-phase transformer 600 with a different structure for changing the tap configuration compared to the multi-phase transformer 100 of FIG. 1. The components of this embodiment are numbered at 6XX as opposed to 1XX, but otherwise correspond to the same or similar components. For example, reference numbers 100 and 600 both correspond to multi-phase transformers. The multi-phase transformer 600 includes secondary voltage stabs 612, 620, primary voltage stabs 608, lug landings 638, tap change links 640, and primary cable attachment lugs 604 and secondary cable attachment lugs 634. To provide further perspective of the embodiment illustrated in FIG. 6, FIG. 7 provides a rear elevational view of the multi-phase transformer 600, and FIG. 8 provides a front elevational view of the multi-phase transformer 600. Analogous to FIG. 2, FIG. 7 shows that the multi-phase transformer 600 may include a neutral terminal. Both FIGS. 7 and 8 illustrate that the core 602 extends through each coil unit 646 of the multi-phase transformer 600.

Figure 9:
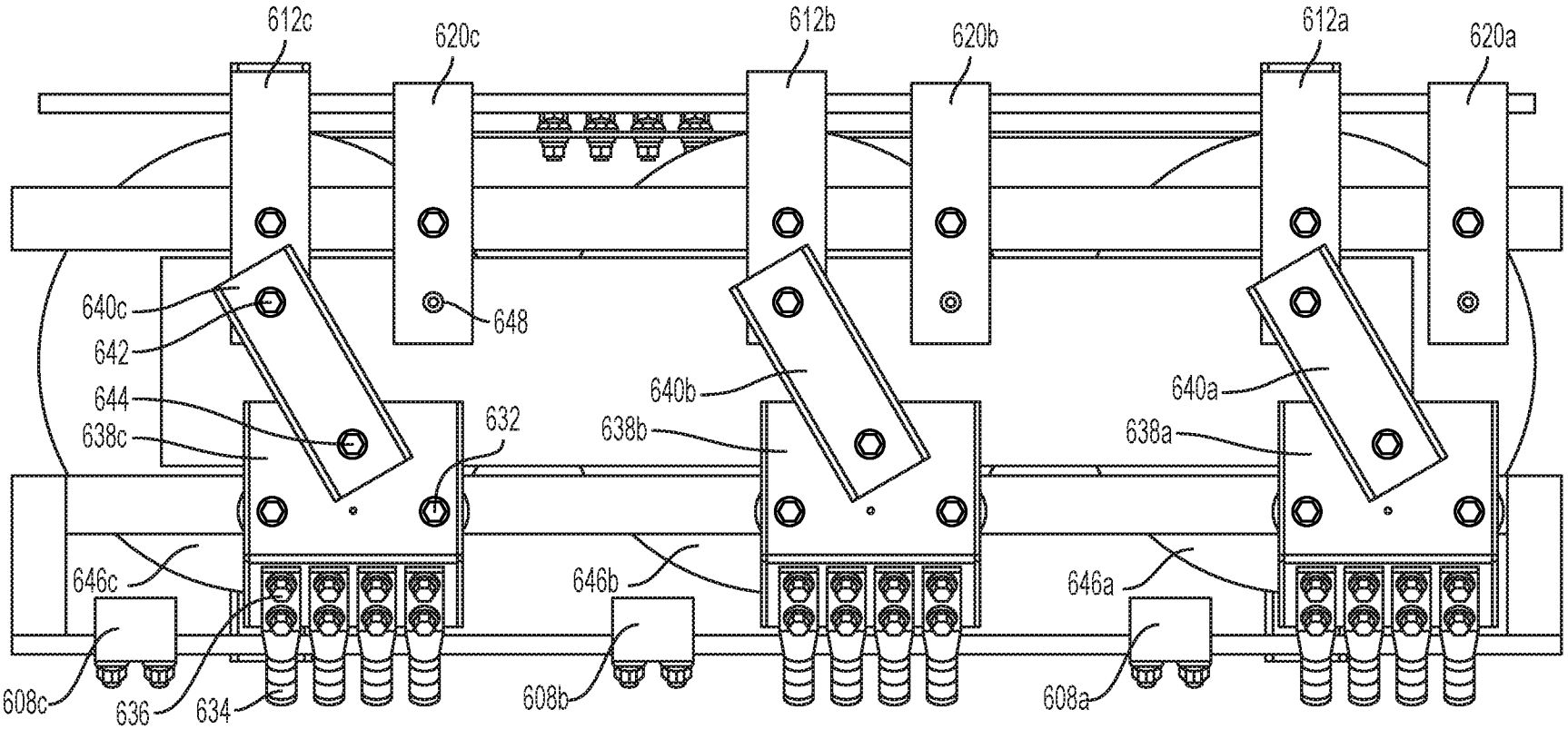
FIG. 9 shows a plan view of the multi-phase transformer of FIGS. 6-8 in a first voltage configuration.
Figure 10:
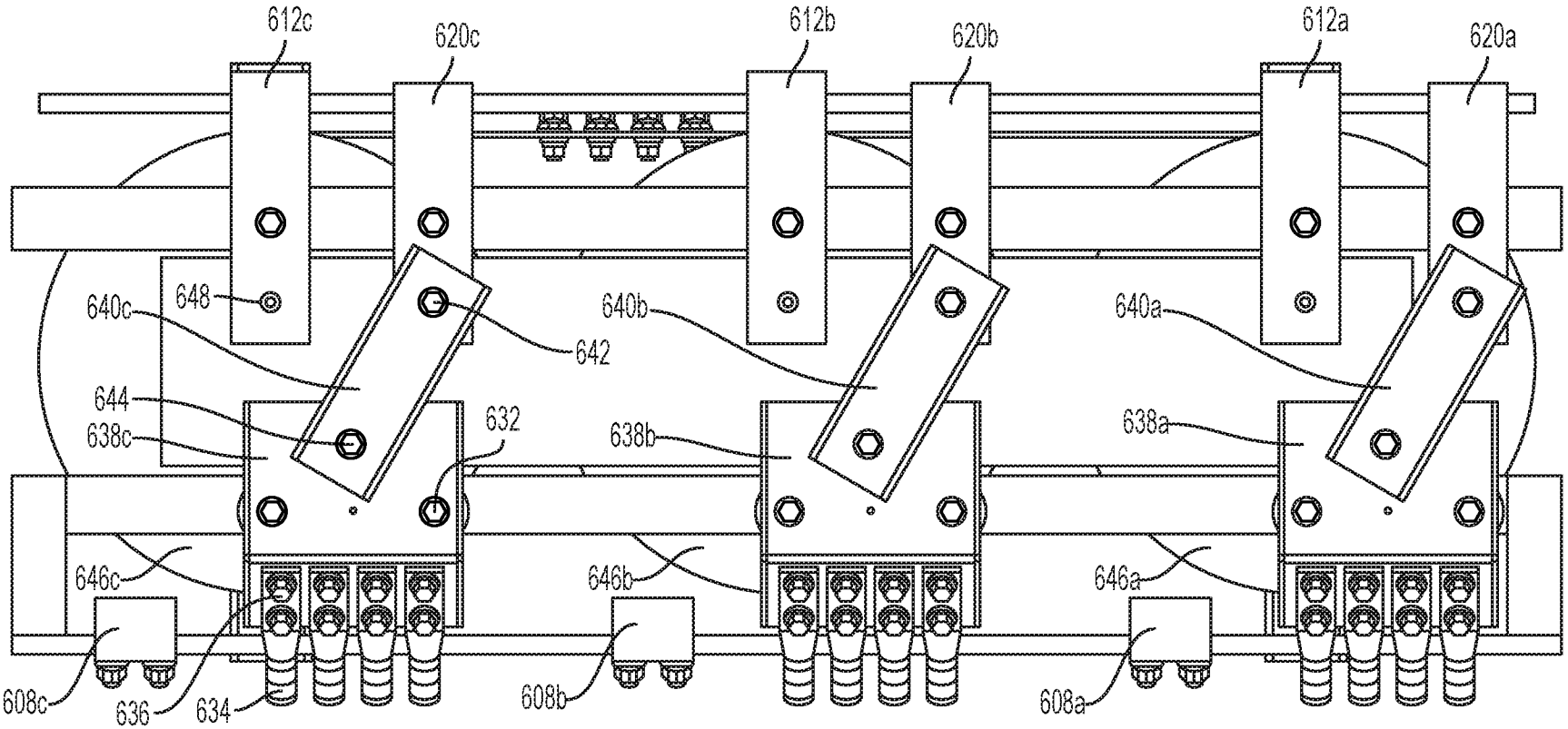
FIG. 10 shows a plan view of the multi-phase transformer of FIGS. 6-8 in a second voltage configuration.

In accordance with an aspect of the disclosure, FIG. 9 illustrates a plan view of the multi-phase transformer 600 of FIG. 6 in a first voltage configuration. In contrast to the embodiment of FIGS. 1-5, wherein fasteners 144 coupling the tap change link 140 to the lug landing 138 are removed from the lug landing 138 and repositioned in alternative openings in the lug landing 138, in the embodiment of FIGS. 6-10, the tap change link 640 may be configured to pivot on a fastener 644 on the lug landing 638 to change connection from one secondary voltage stab to another secondary voltage stab. For example, the tap change link 640*c* may connect to the secondary voltage stab 612*c* in the first voltage configuration and may connect to the secondary voltage stab 620*c* in a second voltage configuration (as shown in FIG. 10). While fastener 644 may be removed and reinserted into the lug landing 638 in the same opening, fastener 644 may serve as the pivot point for the tap change link 640. Fastener 642 may be removed while switching tap configurations to enable the tap change link 640 to be electrically and mechanically disconnected from the secondary voltage stab 612. After pivoting the tap change link 640 to the secondary voltage stab 620, the fastener 642 may be reinstalled to electrically and mechanically connect the lug landing 630 to the secondary voltage stab 620 as shown in FIG. 10. In some embodiments, the range of motion governing the pivoting of the tap change link 640 is limited using stoppers, provided the tap change link 640 has an angular clearance that allows the fastening of the tap change link 640 to each of its secondary voltage stabs 612, 620. Analogous to FIG. 1, in FIG. 6, the fastener 637 mechanically couples the primary cable attachment lugs 604 to the primary voltage stabs 608. Secondary cable attachment lugs 634 are mechanically coupled to the lug landing 638 through the fastener 636. Fastener 632 mechanically couples the lug landing 638 to the transformer core clamp 656 for mounting.

Secondary stabs not connected to the tap change link 640 are shown to have holes 648. Although one fastener 642 is illustrated in FIGS. 9 and 10, it is understood that more than one fastener 642 may be used to secure the tap change link 640 to secondary voltage stabs 612, 620. It will thus be appreciated by those of skill in the art that providing this pivoting motion about fastener 644 may not only reduce time associated with such a change in configuration, it may also minimize the opportunity for mishandling or loss of the fastener 644. Compared to the tap change link 140, the tap change link 640 does not have to be removed from the lug landing 638 in order to switch from one secondary voltage stab to another.

Alternate arrangements of fasteners are also envisioned. By way of example only, a double threaded rod could be threaded into one side of a bore or hole, and a nut engaged with the end of the rod extending through the other side of the bore or hole. Washers may be used in the threaded rod (or bolt) and nut arrangement.

Although the figures illustrate embodiments directed at multi-phase transformers with dual secondary voltage stabs for each individual coil unit, embodiments of the disclosure may be applied to transformers with triple secondary voltage stabs (or more) for each coil unit. Additionally, further embodiments of a transformer with efficiently configurable secondary voltage stabs are contemplated for use in applications that utilize more or less than three coil units illustrated in FIGS. 1-10.

It will be appreciated by those of skill in the art that the disclosed arrangement may yield efficiencies in assembly and minimize material costs associated with fabrication of both the dielectric and the bus bars. Additionally, embodiments of the disclosed transformer with efficiently configurable secondary voltage taps offers numerous improvements over standard cable linking found in the prior art. By utilizing a tap change link according to embodiments of the disclosure, changing a secondary voltage of a transformer may be performed with much greater ease.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A transformer for providing selectively configurable output voltages, the transformer configured to receive a primary incoming voltage and provide at least two secondary output voltages, the transformer comprising:

at least one secondary output assembly, the secondary output assembly including:

at least two secondary voltage stabs, wherein the number of voltage stabs is the same as the number of secondary output voltages, and wherein the secondary voltage stabs are connected and configured to provide access to a respective secondary output voltage of the at least two secondary output voltages;

a lug landing;

at least one secondary cable attachment lug supported on and electrically connected with the at least one lug landing;

a tap change link, the tap change link being configured for attachment to the lug landing and either of the at least two secondary voltage stabs;

at least one fastener coupling the tap change link to the lug landing; and at least one fastener coupling the tap change link to one of the at least two secondary voltage stabs.

2. The transformer according to claim 1, including three secondary output assemblies, wherein each secondary output assembly includes two secondary voltage stabs.

3. The transformer according to claim 2, configured to step up the primary incoming voltage to provide two secondary output voltages with magnitude larger than the primary incoming voltage.

4. The transformer according to claim 2, configured to step down the primary incoming voltage to provide two secondary output voltages with magnitude smaller than the primary incoming voltage.

5. The transformer according to claim 1, wherein the secondary voltage stabs are mechanically coupled to the transformer via dielectric insulators.

6. The transformer according to claim 1, wherein the secondary voltage stabs are mechanically coupled to a transformer core clamp of the transformer.

7. The transformer according to claim 1, wherein the lug landing includes a plurality of secondary cable attachment lugs.

8. The transformer according to claim 7, wherein a number of secondary cable attachment lugs is based on a maximum current of the lug landing.

9. The transformer according to claim 7, wherein a set of fasteners is configured to couple the at least one secondary cable attachment lugs to the lug landing.

10. The transformer according to claim 7, further comprising:

at least one primary voltage stab, the primary voltage stab being configured to couple the primary incoming voltage to the transformer, and the primary voltage stab including at least one primary cable attachment lug, wherein a number of secondary cable attachment lugs is greater than a number of primary cable attachment lugs.

11. The transformer according to claim 1, wherein the tap change link is configured to pivot at the at least one fastener coupling the tap change link to the lug landing in order to select one secondary voltage stab in a respective grouping of secondary voltage stabs.

12. The transformer according to claim 1, wherein at least one of the at least one fastener coupling the tap change link to the lug landing and the at least one fastener coupling the tap change link to one of the at least two secondary voltage stabs includes a threaded rod.

13. The transformer of claim 1, wherein the lug landing includes a plurality of openings for receipt of the at least one fastener coupling the tap change link to the lug landing.

14. The transformer of claim 13, wherein the at least one fastener coupling the tap change link to the lug landing is disposed in one of the plurality of openings when the tap change link is coupled to a first of the at least two secondary voltage stabs, and the at least one fastener coupling the tap change link to the lug landing is disposed in another of the plurality of openings when the tap change link is coupled to a second of the at least two secondary voltage stabs.

15. The transformer of claim 1, wherein the at least one secondary output assembly includes greater than two secondary voltage stabs.

16. The transformer of claim 1, wherein a first of the at least two secondary output voltages is provided to the at least one secondary cable attachment lug when the tap change link is coupled between the lug landing and a first of the at least two secondary voltage stabs, and a second of the at least two secondary output voltages is provided to the at least one secondary cable attachment lug when the tap change link is coupled between the lug landing and a second of the at least two secondary voltage stabs.

17. A transformer for providing selectively configurable output voltages, the transformer configured to receive two or more primary incoming voltages and provide at least two secondary output voltages, the transformer comprising:

at least two secondary output assemblies, each secondary output assembly including:

at least two secondary voltage stabs, wherein the number of voltage stabs is the same as the number of secondary output voltages, and wherein the secondary voltage stabs are connected and configured to provide access to a respective secondary output voltage of the at least two secondary output voltages;

a lug landing;

at least one secondary cable attachment lug supported on and electrically connected with the at least one lug landing;

a tap change link, the tap change link being configured for attachment to the lug landing and either of the at least two secondary voltage stabs;

at least one fastener coupling the tap change link to the lug landing; and at least one fastener coupling the tap change link to one of the at least two secondary voltage stabs; and at least two primary voltage stabs, each primary voltage stab being configured to couple the two or more primary incoming voltages to the transformer, wherein a respective primary voltage stab of the at least two primary voltage stabs corresponds to a respective secondary output assembly of the at least two secondary output assemblies.

18. The transformer of claim 17, wherein each secondary output assembly further includes:

a coil unit including a primary winding and at least two secondary windings, wherein a number of secondary windings is the same as the number of voltage stabs.

* * * * *